US008057301B2

(12) United States Patent
Duhamel

(10) Patent No.: US 8,057,301 B2
(45) Date of Patent: Nov. 15, 2011

(54) GAME FEATURE ASSOCIATED WITH AN ENHANCEMENT OF A PROGRESSIVE PRIZE

(75) Inventor: Gerald Duhamel, Drummondville (CA)

(73) Assignee: Labtronix Concept inc., Drummondville, QC (CA)

( * ) Notice: Subject to any disclaimer, the term of this patent is extended or adjusted under 35 U.S.C. 154(b) by 1096 days.

(21) Appl. No.: 11/602,986

(22) Filed: Nov. 22, 2006

(65) Prior Publication Data

US 2007/0117614 A1 May 24, 2007

Related U.S. Application Data

(60) Provisional application No. 60/738,604, filed on Nov. 22, 2005.

(51) Int. Cl.
*A63F 13/00* (2006.01)
*A63F 13/10* (2006.01)

(52) U.S. Cl. ..... 463/27; 463/21; 463/25; 273/138.1; 273/139

(58) Field of Classification Search ..... 463/17–22, 463/24–29, 33, 42–43, 47; 273/138.1, 138.2, 273/139, 141 A, 269, 454–456, 460–461; *A63F 13/00, 13/10*

See application file for complete search history.

(56) References Cited

U.S. PATENT DOCUMENTS 4,837,728 A * 6/1989 Barrie et al. ..... 463/27
5,078,405 A 1/1992 Jones
5,393,067 A 2/1995 Paulsen et al.
5,417,430 A 5/1995 Breeding
5,454,570 A 10/1995 Karal
5,482,289 A * 1/1996 Weingardt ..... 273/269
5,544,892 A 8/1996 Breeding
5,613,679 A 3/1997 Casa
5,707,287 A 1/1998 McCrea, Jr.
5,794,934 A 8/1998 Malcolm
5,829,748 A 11/1998 Moore, Jr.
5,911,626 A 6/1999 McCrea, Jr.
6,007,427 A 12/1999 Wiener et al.
6,059,659 A 5/2000 Busch et al.
6,179,711 B1 1/2001 Yoseloff
6,241,608 B1 * 6/2001 Torango ..... 463/27
6,328,649 B1 * 12/2001 Randall et al. ..... 463/20
6,485,368 B2 * 11/2002 Jones et al. ..... 463/13
6,966,834 B1 * 11/2005 Johnson ..... 463/25
7,029,395 B1 * 4/2006 Baerlocher ..... 463/20
7,255,645 B2 * 8/2007 Steil et al. ..... 463/27
7,419,430 B1 * 9/2008 Joshi et al. ..... 463/27
(Continued)

FOREIGN PATENT DOCUMENTS

EP 0 443 420 B1 1/1995

*Primary Examiner* — Arthur O. Hall
(74) *Attorney, Agent, or Firm* — Benoît & Côté

(57) ABSTRACT

Embodiments of the present invention provide methods, systems and programs for conducting a feature in relation with a wagering game. In one embodiment, a method comprises receiving a first wager value and a second wager value; establishing evaluation conditions and increment a progressive prize based on this first wager value; and establishing an enhancement level of the progressive prize based on this second wager value. The method further comprising generating game outcomes, evaluating game outcomes, and awarding payouts based on evaluation of these game outcomes, wherein the prize value awarded for a progressive-prize winning outcome is based on the established enhancement level.

16 Claims, 7 Drawing Sheets

U.S. PATENT DOCUMENTS

| | | | | |
|---|---|---|---|---|
| 7,578,739 | B2 * | 8/2009 | Gauselmann | 463/27 |
| 7,597,621 | B2 * | 10/2009 | Baerlocher | 463/28 |
| 7,666,093 | B2 * | 2/2010 | Lafky et al. | 463/26 |
| 7,717,788 | B2 * | 5/2010 | Rowe | 463/25 |
| 2001/0024969 | A1 | 9/2001 | Jones | |
| 2002/0077168 | A1 * | 6/2002 | Jones et al. | 463/13 |
| 2002/0151354 | A1 | 10/2002 | Boesen et al. | |
| 2002/0190469 | A1 * | 12/2002 | Conklin et al. | 273/292 |
| 2002/0195776 | A1 | 12/2002 | Jones | |
| 2003/0222402 | A1 | 12/2003 | Olive | |
| 2004/0242317 | A1 * | 12/2004 | Fong | 463/20 |
| 2004/0242320 | A1 * | 12/2004 | Jackson | 463/26 |
| 2005/0059481 | A1 * | 3/2005 | Joshi et al. | 463/27 |
| 2005/0119044 | A1 * | 6/2005 | Lim et al. | 463/25 |
| 2005/0130737 | A1 * | 6/2005 | Englman et al. | 463/25 |
| 2005/0187014 | A1 * | 8/2005 | Saffari et al. | 463/27 |
| 2005/0215311 | A1 | 9/2005 | Hornik | |
| 2006/0052160 | A1 * | 3/2006 | Saffari et al. | 463/27 |
| 2006/0149561 | A1 | 7/2006 | Govender | |
| 2007/0026941 | A1 * | 2/2007 | Block et al. | 463/29 |
| 2007/0054728 | A1 * | 3/2007 | Hood | 463/16 |
| 2007/0060314 | A1 * | 3/2007 | Baerlocher et al. | 463/25 |
| 2007/0060365 | A1 * | 3/2007 | Tien et al. | 463/42 |
| 2008/0015012 | A1 * | 1/2008 | Englman et al. | 463/25 |
| 2009/0042643 | A1 * | 2/2009 | Gagner et al. | 463/27 |
| 2009/0305777 | A1 * | 12/2009 | Anderson | 463/27 |
| 2011/0003636 | A1 * | 1/2011 | Thomas et al. | 463/27 |

* cited by examiner

GAME FEATURE ASSOCIATED WITH AN ENHANCEMENT OF A PROGRESSIVE PRIZE

CROSS-REFERENCE TO RELATED APPLICATIONS

This application claims priority under 35 US§119(e) of U.S. provisional patent application 60/738,604, filed on Nov. 22, 2005 and entitled Method and System to Provide a Player-Dependent Jackpot, the specification of which is hereby incorporated by reference.

SUMMARY OF THE INVENTION

An embodiment of the present invention provides a method of conducting a wagering game. The method comprises the steps of receiving a first wager from a player that is used to establish the evaluation conditions in the game. It further comprises receiving a second wager used to establish an enhancement level of an available progressive prize. The method also comprises incrementing the progressive prize based on the first wager value, generating a game outcome, and evaluating the game outcome to determine if winning conditions are satisfied. The method further comprises awarding an enhanced progressive prize to the player upon the satisfied winning condition being one associated with winning the progressive prize, with the value of the enhanced progressive prize depending on the enhancement level resulting from the second wager.

Another embodiment of the present invention provides a system adapted for providing an optional enhancement to a progressive prize in a wagering game, the gaming system comprising a plurality of components:—wager—receiving means for receiving a first wager value and a second wager value from a player;—processing means for processing received said first and said second wager values to establish parameters for conducting said wagering game, the processing means establishing evaluation conditions, comprising winning criteria, based on the received first wager value and establishing a level of enhancement of a progressive prize based on said second wager value;—progressive—managing means for managing a progressive prize comprising incrementing value of said progressive prize based on the received first wager value;—outcome—generating means for generating a game outcome;—evaluating means for evaluating the game outcome against said winning criteria, wherein said winning criteria are associated with a plurality of regular payouts and the progressive prize; and—awarding means for awarding a payout based on the evaluating means evaluating fulfillment of one said winning criterion, comprising awarding, upon fulfillment of one said winning criterion associated with the progressive prize, a progressive prize with its value being based on the level of enhancement established by said processing means.

A further embodiment of the present invention provides a computer program embodied on a computer readable medium or in a processor-readable memory having codes adapted for controlling a wager receiving process in which a first wager value and a second wager value are received from a player in a wagering game, the first wager value being used to establish evaluation conditions of the wagering game, comprising winning criteria, and for incrementing a progressive prize. The codes being further adapted for establishing a level of enhancement of a progressive prize based on the second wager value, wherein upon evaluation of an outcome fulfilling a progressive-prize winning condition, a payout is awarded based on a current value of the progressive prize and the level of enhancement established based on the second wager value.

BRIEF DESCRIPTION OF THE DRAWINGS

Further features of the present invention will become apparent from the following detailed description, taking in combination with the appended drawings, in which.

It will be noted that throughout the appended drawings, like features are identified by like reference numerals.

DETAILED DESCRIPTION OF THE EMBODIMENTS OF THE INVENTION

In order to provide a good understanding of the invention, in this application the terms "outcome" and "game outcome" mean "game data evaluated against criteria to provide a useful result". This outcome is usually composed of a plurality of indicia structured according to a game structure, with this plurality of indicia being evaluated against evaluation condition(s), or criteria, in order to obtain this useful result.

The terms "evaluation condition" means "the parameters involved in the evaluation of the game outcome in order to obtain this useful result". Such parameters may comprise the number of activated pay lines in a line game, the number of credits per pay line, the static pay schedule used for the resolution of the wagers, states determining the availability or the unavailability of prizes or features in the game, etc.

The terms "enhancement" and "enhancement level" are related to an increase or a rise in a value. Therefore, the enhancement of a prize results in a higher prize value being awarded upon the win of said prize.

Figure 1:
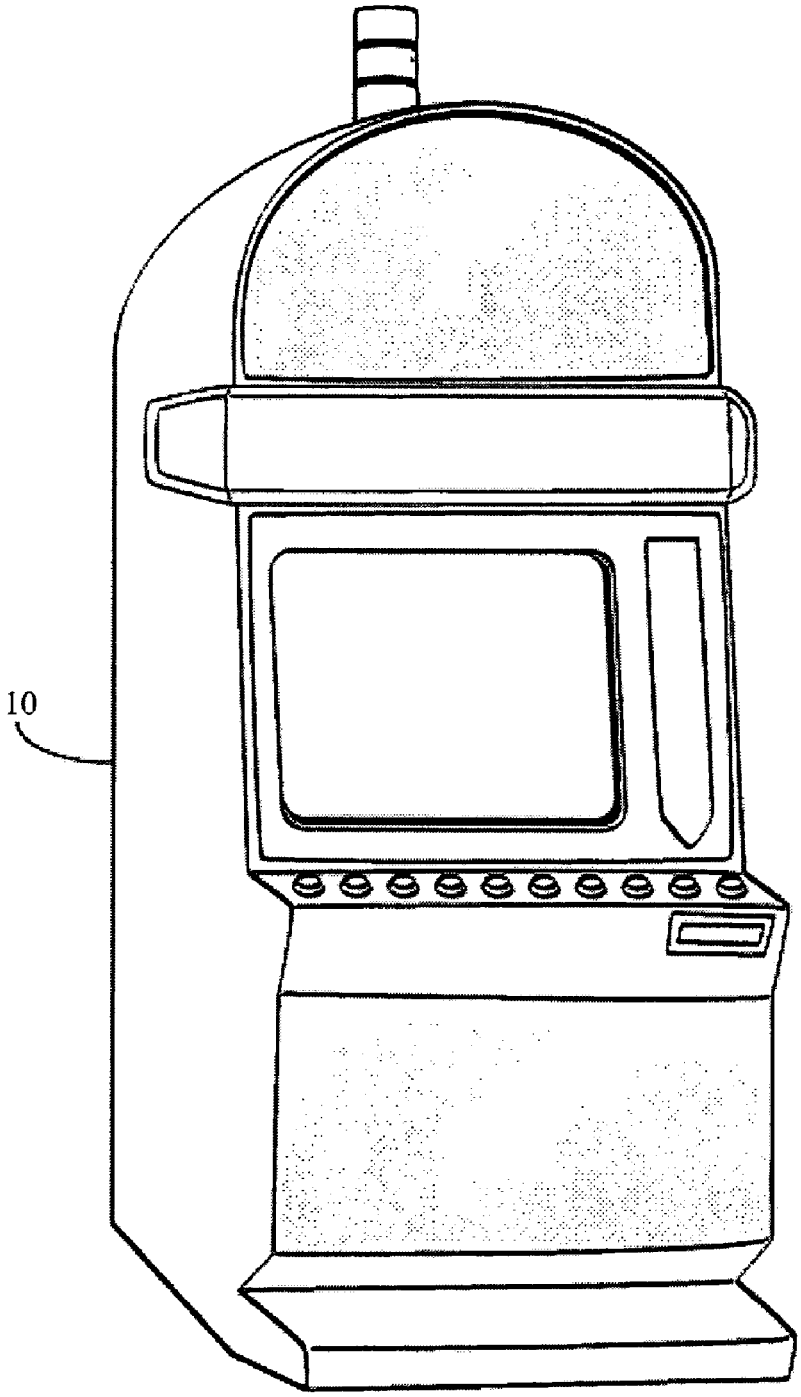
FIG. 1 illustrates a perspective view of a gaming machine suitable for embodiments of the present invention.
Figure 2:
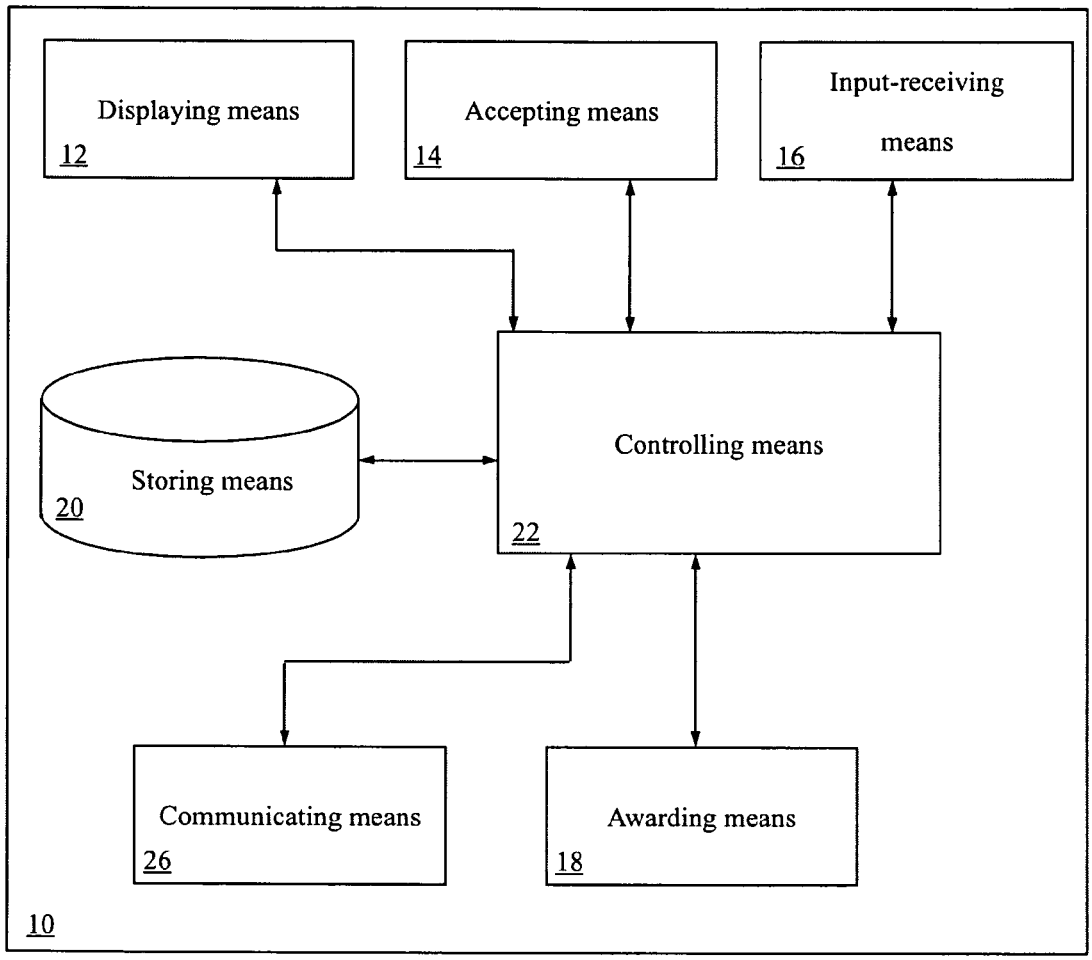
FIG. 2 is a block diagram illustrating the components of the gaming machine of FIG. 1.

An embodiment of the present invention may be carried out in part on a gaming machine, as illustrated on FIGS. 1 and 2. The gaming machine 10 comprises displaying means 12, such as a video screen or a LCD screen; accepting means 14, such as a card reader, a ticket reader, or a coin and/or bill acceptor; input-receiving means 16, such as buttons, levers or a touch screen; awarding means 18, such as a ticket printer, a card reader or a hopper; storing means 20, such as RAM, flash memory, a hard drive or a removable memory medium; and controlling means 22, such as a computer, computer codes, or a hardware controller. Gaming machine 10 comprises communicating means 26, such as a network communication controller and a network connection, or a wireless communication capability. In another embodiment, the gaming machine 10 carrying out the invention may comprise, either in replacement of or in combination with the accepting means 14, communicating means 26 allowing communication between the controlling means 22 and remotely linked accounting means (not shown) wherein player accounts are maintained (either by a casino or by a financial institution, such as a bank), and monetary value is downloaded on the gaming machine 10 to play the game and uploaded on the accounting means upon quitting the game.

Figure 3:
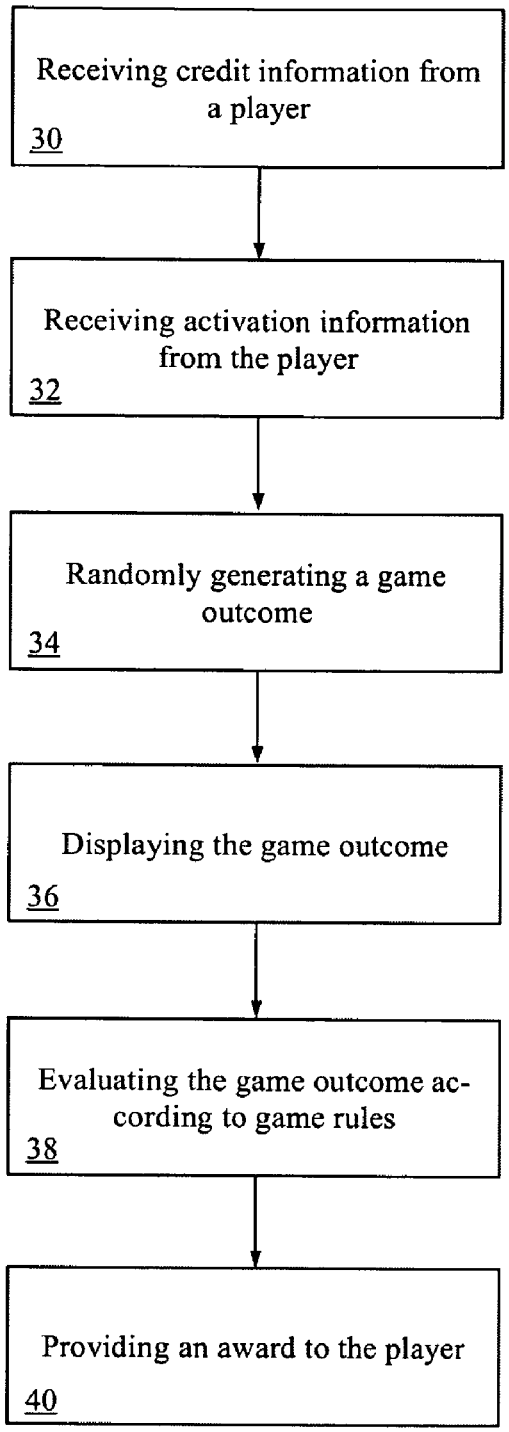
FIG. 3 is a flow chart providing the steps performed by a gaming machine while playing a game according to an embodiment of the present invention.

Such a gaming machine 10 is designated, as shown on FIG. 3, to provide a player with a participation in a wagering game. Such a game participation involves receiving credit information from a player (at step 30) coming from the deposit of money either in a physical format (such as coins or bills) or in an electronic format (such as money stored on a player card or transfer from a bank account), receiving activation information from the player (at step 32), randomly generating (at step 34) and displaying (at step 36) a game outcome, evaluating the game outcome according to game rules (at step 38), and providing the player with the award(s) corresponding to the evaluated outcome (at step 40). Depending on the evaluated outcome, the award may comprise a prize, the initiation of a feature, or the participation of a special feature such as a bonus feature or a tournament.

Figure 4:
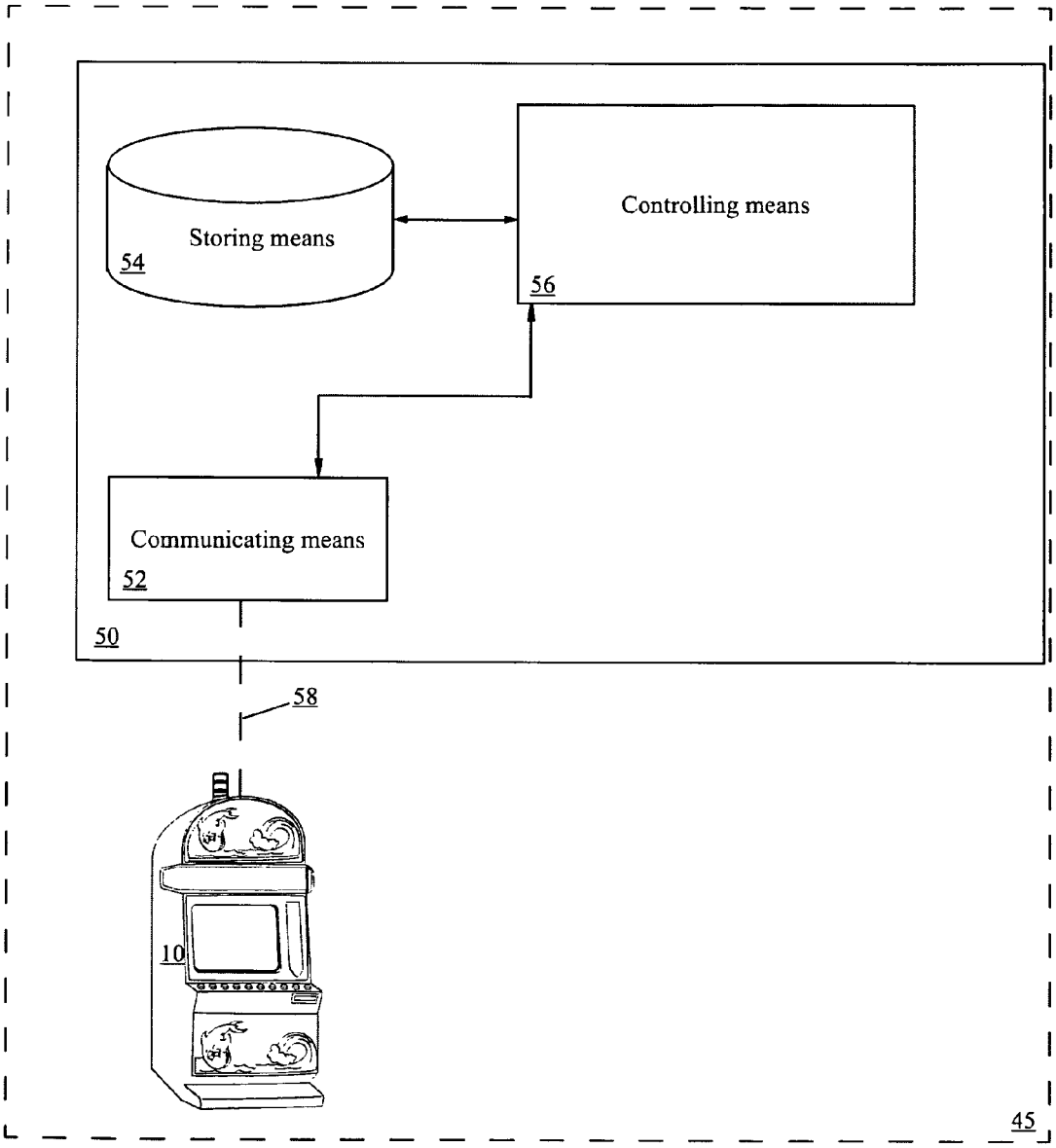
FIG. 4 is a block diagram illustrating the components of a bingo server communicatively linked to gaming machines such as the one illustrated on FIGS. 1 and 2 according to an embodiment of the present invention.

Depending on the desired configurations, the game, the monitoring needs, etc., a gaming system 45, as illustrated on FIG. 4, may be involved in providing participations in a wagering game. The gaming system 45 would comprise a plurality of gaming machines 10; communicating means 52, such as a network communication controller; and a network connection or a wireless communication capability 58; and a game server 50. The latter would comprise storing means 54 such as RAM, flash memory, a hard drive, or a removable memory medium; and controlling means 56 such as a computer, computer codes, or a hardware controller. The game server 50 would be responsible to perform at least one of managing a progressive prize system; managing players' accounts; generating outcomes; signaling gaming machines 10 of features to provide; operating a player tracking program; providing security controls; etc.

According to embodiments, a gaming machine alone or a system comprising a gaming machine may be necessary with some functions necessary to the invention being performed by one or another component of the system. For example, depending on whether a gaming machine alone manages a progressive prize system for the gaming machine alone, for a bank of networked gaming machines, or a remotely linked progressive prize system managing this function, the embodiments will vary while still fall into the scope of the present invention.

Alternative embodiments of the invention comprise computer programs embodied on a computer readable medium or in a processor-readable memory having codes adapted to conduct methods embodying the invention. The alternative embodiments are also intended to be protected as they fall into the spirit and scope of the invention.

Figure 5:
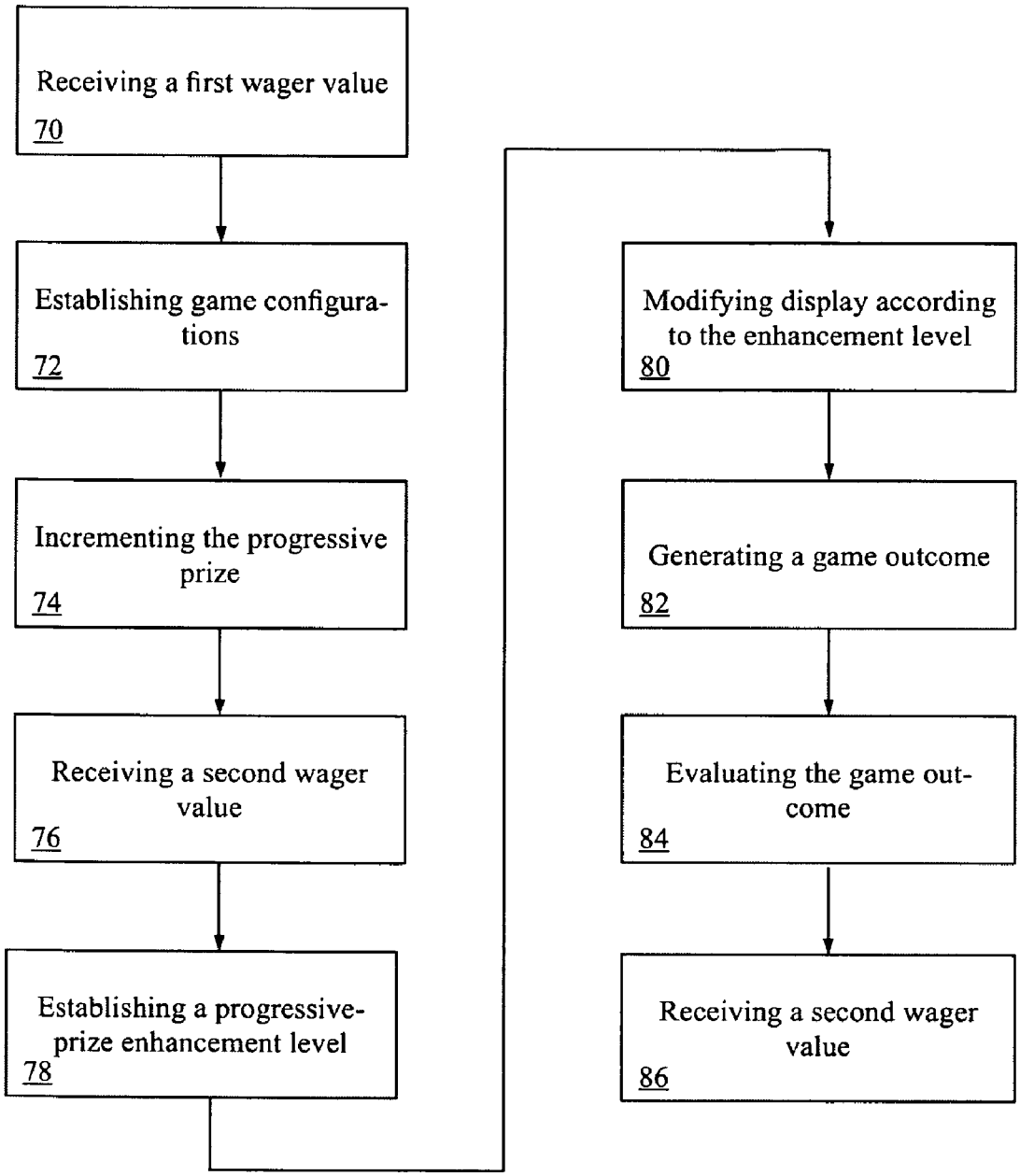
FIG. 5 is a flow chart illustrating the steps performed in relation with the processing of wager values.

As one embodiment of the invention, a method of conducting a wagering game is described and illustrated on FIG. 5. The method comprises receiving a first wager value from a player (at step 70). This wager value is used to establish the participation of the player in the game, including to determine the configurations necessary to the resolution of this wager (at step 72) and to increment a progressive jackpot prize (at step 74). The method further comprises receiving a second wager value from the player (at step 76), establishing accordingly a progressive prize enhancement level (at step 78), and dynamically displaying the progressive prize available to be won according to this second wager value (at step 80). The method further comprises generating a game outcome (at step 82), evaluating the game outcome against win criteria (at step 84), and awarding a prize according to the game outcome evaluation (at step 86). If the game outcome fulfills a progressive-prize winning criterion, the prize awarded to the player is the enhanced progressive prize, with the progressive prize being reset to its seed value.

Figure 6:
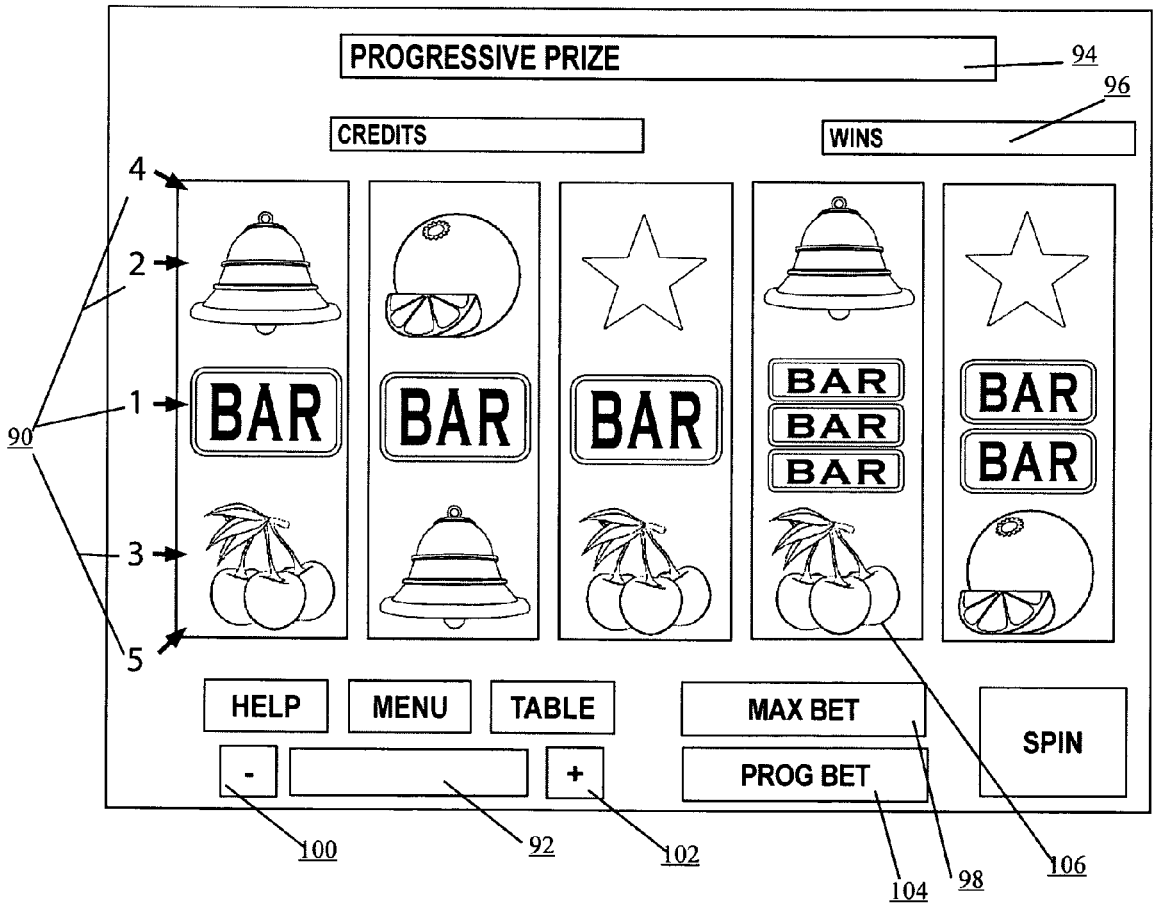
FIG. 6 is a schematic of a game interface used in relation with a line-game embodiment of the present invention, this game interface comprising a progressive-prize window.

An example of the above embodiment is a multi-reel line game played on a networked gaming machine linked to a progressive controller; the interface of the line game being illustrated on FIG. 6. To play the game, the player places a first wager value using any of the soft controls 98, 100 and 102. Soft controls 98 allows the player to place, through a single action, a maximum wager value on all pay lines 90, while soft controls 100 and 102 allow a step-by-step configuration of the wager value. Soft control 104 allows placing a second wager value when this option is available. As the player establishes his wager value, this value is dynamically illustrated on the wager window 92. The wager configuration, in its step-by-step manner, is performed as follows: a) the first credits wagered are used for activating the pay lines 90 and associating a single credit to each of them; b) when all pay lines have been activated, the wager associated with each pay line is evenly increased between the pay lines (thus resulting in a modification of five (5) credits of the wager level); and c) when all pay line wager has reached their maximum, a progressive bet is added. In the present example, the player may active up to five (5) pay lines 90 with the activation status of a pay line 90 being illustrated as the pay line indicator of an active pay line being displayed in a first manner while being displayed in a second manner when the pay line 90 is inactive. The player has the option to place from one (1) to five (5) credit per pay line. As soon as the player places at least three (3) credits per pay line 90, the player participate in the progressive jackpot. Regardless of the wager value placed by the player, a portion of the first wager value, in the present example two percent (2%) of this value, is used to increment the progressive jackpot value (with its current value being illustrated in the progressive window 94 by default). After having placed his first wager, the player may place a second wager value of one (1) or two (2) credits; this wager value being also displayed in the wager window 92. If the player does so, the available progressive jackpot value displayed on the gaming machine in the progressive window 94 is accordingly enhanced (thus differing from the progressive prize current value). Following an activation command from the player, an outcome composed of fifteen (15) symbols 106 is generated; the game outcome is evaluated in view of the active pay lines 90; and a payout, displayed in the winning window 96, is established based on this evaluation and the pay line wager values. If the outcome is evaluated as comprising a progressive-prize winning outcome, the player is awarded the progressive prize value displayed in the progressive window 94 regardless of the current progressive prize current value.

The gaming machine, in view of the above example, may accept a single wager process, with a first portion of the wager, the twenty-five (25) first credits, being applied to configure the pay lines, and the extra portion of the wager, if any, being used to enhanced the progressive prize. Accordingly, the player would be able to place in the present example up to twenty-six (26) credits, with the twenty-sixth ($26^{th}$) credit being used to enhance the progressive prize value the player may win.

According to another embodiment, the progressive prize system manages three (3) progressive prizes each associated with its own winning outcome and each having its own probabilities of occurring. The portion of the first wager used to increment the progressive prize is divided between the three (3) progressive prizes: one percent (1%) for the top progressive prize, half a percent (0.5%) for the second one, and half a percent (0.5%) for the lowest one of the progressive prizes. According to the first wager value placed by the player, the player may participate in none to all of these progressive prizes. Based on the first wager value, the player may be prevented from placing a second wager value (if none of the progressive prizes are available with the placed first wager value), or the player placing a second wager value may enhance one to all of the progressive prizes.

An example of the above embodiment may be illustrated through a three-hand poker game. In this game (not illustrated), the player may activate one (1) to three (hands) with a maximum wager placed on a first hand activating the first progressive jackpot, a maximum wager placed on two (2) hands activating the second progressive jackpot, and a maximum hand being placed on the three (3) hands activating the three (3) progressive jackpots. If the player places a single-credit second wager, the active jackpot(s) is (are) enhanced at a first enhancement level. If the player places a second wager of two (2) credits, the active jackpot(s) is (are) enhanced to a second enhancement level. According to the final hand ranking of the active hand(s) and the first wager value, the player may win the first, the second or the third jackpot. Winning the bottom jackpot requires a first hand ranking at a rank $k_{a1}$ or better. Winning the middle jackpot requires the first hand to rank at a rank $k_{a2}$ or better and the second hand to rank at a rank $k_{b2}$ or better. Winning the top jackpot requires the first hand to rank at a rank $k_{a3}$ or better, the second hand to rank at a rank $k_{b3}$ or better, and the third hand to rank at a rank $k_{c3}$ or better. Typically, the ranks necessary for a hand to win a jackpot do not change with the evaluated jackpot. Furthermore, the hand ranking of the first hand is usually the highest (e.g. a royal flush ranking), and the necessary hand rankings being the same or decreasing in ranking as the evaluated jackpot increases (e.g.: first hand requiring a royal flush, second hand requiring a four-of-a-kind hand with a particular kicker card or a royal flush, and third hand requiring any four-of-a-kind hand or a royal flush).

In the above example, the portion of the second wager used for enhancing the progressive prize may vary according to the activated jackpot(s). Demanding the same second wager for the same enhancement level, the portion is unused if one or more of the jackpots are not available to be won.

According to embodiments, the second wager value may be used completely to cover the expected value of the progressive enhancement, a portion of that second wager value may be kept by the progressive system to cover management costs or to generate profits for the progressive prize provided, a portion may be used to increase one or more progressive jackpot values, a portion may be used to increase the value of a hidden progressive prize replacing the current progressive jackpot value upon said jackpot value being won.

Figure 7:
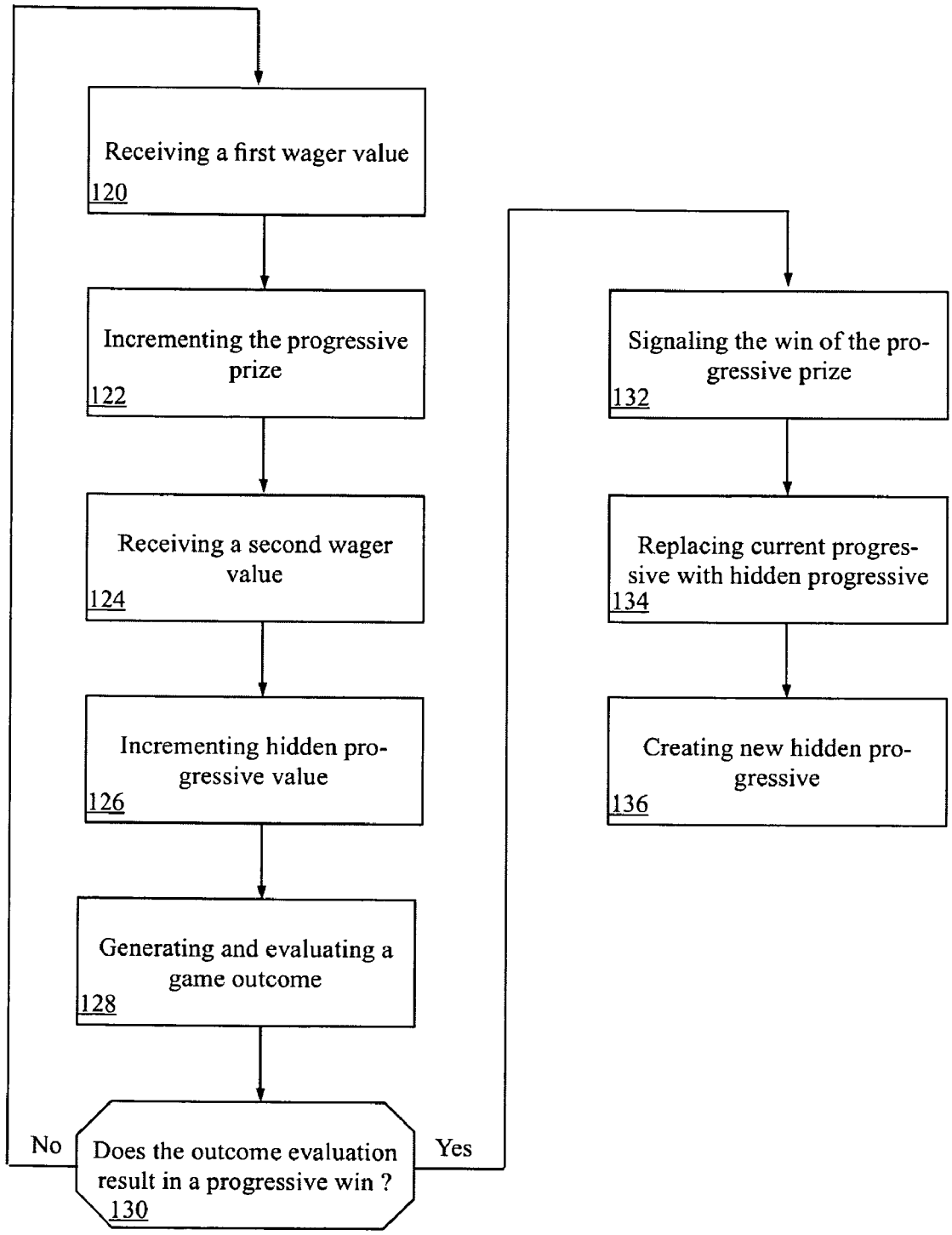
FIG. 7 is a flow chart regarding the processing of a progressive prize in relation with the processing of wager values and progressive prize winnings.

Flow chart of FIG. 7 illustrates one example of the steps associated with the management of the wager values in regard of the progressive prizes. First, the first wager value is received (at step 120) with a portion of that first wager increasing the value of the progressive prize (at step 122). The second wager is received (at step 124) with a portion of that second wager being used to increment a hidden progressive value (at step 126) with these steps taking place on a progressive system upon initiation of a game play by the player on a gaming machine. An outcome is generated and evaluated (at step 128). If the progressive winning outcome is evaluated (evaluation performed at step 130), this outcome is signaled to the progressive system (at step 132). The player is awarded the enhanced progressive prize. The current progressive jackpot value is replaced by the hidden one (at step 134) and a new hidden jackpot value is established (at step 136).

The nature of the enhancement to the progressive prize may also vary depending on the physical configuration, the game configuration and other parameters. For example, the progressive prize enhancement may be function of the occurrence probabilities of the progressive winning outcome and of the second wager value. In this context, a progressive prize enhancement is established based on the value of second wager level. In another example, the progressive enhancement may be a multiplication of the current progressive prize by a factor (e.g. to double its current value), with this factor being determined based on the probabilities of occurrence of the progressive-prize winning outcome, the average value of the progressive prizes when they are won, and of the second wager value. In the last example, the risk the progressive-prize providing entity may take providing the progressive-prize enhancement will change as the progressive prize value increases.

Those skilled in the art may recognize other embodiments and/or methods to provide such functionalities. It will be noted that the described embodiments illustrate different characteristics the invention may present. Those skilled in the art will recognize that, even if the instant embodiments describe these characteristics as part of different devices, one could differently use or combine some of these characteristics without departing from the scope of the invention as intended to be set. Furthermore, non-described embodiments may also present other characteristics and/or variations, with such characteristics falling within the scope of the invention, as set forth in the appended claims.

Thus, it is the intent through the instant document to efficiently teach the invention through embodiments, while defining the scope of the invention solely through the appended claims.

The invention claimed is:

1. A method of conducting a wagering game on a gaming machine configured to receive wagers and to award prizes based on outcomes of a wagering game, the method comprising the steps of:

receiving a first wager of a first wager value greater than zero from a player on the gaming machine, the first wager value being used to establish player participation in the game, the player participation comprising (i) participation to win a regular payout, and (ii) participation to win a progressive prize according to a probability;

in addition to the first wager, receiving a second wager of a second wager value greater than zero, and establishing, based on the second wager value, a level of enhancement of the progressive prize without influencing the probability of the player to win the progressive prize;

incrementing a current value of the progressive prize using at least a portion of the first wager value;

in response to incrementing, calculating an enhanced progressive prize value based on (i) the current value of the progressive prize; and (ii) the level of enhancement of the progressive prize established based on the second wager value;

generating a game outcome;

evaluating said game outcome against winning criteria for the game to establish if the player wins any of the regular payout and the progressive prize;

awarding a payout to said player on the gaming machine, the payout being the sum of (i) the regular payout; and (ii) the enhanced progressive prize value when the progressive prize is won.

2. The method of claim 1, further comprising the step of: receiving a single wager from said player; and establishing a first portion of the single wager as the first wager value and the remaining portion of the single wager as the second wager value.

3. The method of claim 2, further comprising the step of: establishing said first portion based on a wager threshold, the portion of the single wager under the wager threshold establishing the first wager value and the portion of the single wager over the wager threshold establishing the second wager value.

4. The method of claim 1, wherein said progressive prize is composed of a plurality of independent progressive prizes each associated with a particular progressive-prize winning outcome and each used to establish when one of said plurality of progressive prizes is to be awarded upon an evaluation of the particular progressive-prize winning outcome associated therewith, the method further comprising: establishing a level of enhancement of at least one of the progressive prizes based on said second wager value.

5. The method of claim 1, further comprising: incrementing the current value of the progressive prize with a portion of the second wager value.

6. The method of claim 1, wherein said enhancement level comprises one of: an additional value increasing the current value of the progressive prize, with this additional value being based on the second wager value; and an increase of the payout value associated with the fulfillment of the winning criteria for the game.

7. The method of claim 6, wherein said increase of the payout value associated with the fulfillment of the winning criteria for the game comprises a multiplication of the current value of the progressive prize with a factor over 1.00.

8. The method of claim 1, wherein the established enhancement level is selected among a plurality of enhancement levels based on the second wager value placed by the player.

9. The method of claim 1, further comprising incrementing a current value of a hidden progressive prize using a portion of the second wager value.

10. The method of claim 1, embodied in a gaming machine performing a dynamical enhancement of a representation of the progressive prize as a selection of the second wager value is performed by the player.

11. The method of claim 1, further comprising verifying that the received first wager value has reached a minimum value before accepting a second wager from the player.

12. The method of claim 1, wherein the step of receiving a second wager from said player comprises receiving a player selection of the second wager value among two or more distinct wager values; and the step of establishing the enhancement level comprises basing the level of enhancement on the selected second wager value.

13. A gaming system providing an optional enhancement to a progressive prize in a wagering game, the gaming system comprising: a plurality of components comprising wager-receiving means receiving a first wager of a first wager value greater than zero and a second wager of a second wager value greater than zero from a player;

processing means processing the received first wager and the received second wager, establishing player participation in the game based only on the first wager value, the player participation comprising (i) participation to win a regular payout, and (ii) participation to win a progressive prize according to a probability; and establishing, based on the second wager value, a level of enhancement of the progressive prize without influencing the probability of the player to win the progressive prize;

progressive-managing means managing the progressive prize comprising incrementing a current value of the progressive prize using at least a portion of the received first wager value and, in response to incrementing, calculating an enhanced progressive prize value based on the current value of the progressive prize and the established level of enhancement of the progressive prize;

outcome-generating means generating a game outcome;

evaluating means evaluating the game outcome against winning criteria for the game to establish if the player wins any of the regular payout and the progressive prize; and awarding means awarding a payout based on the evaluating means, the payout being the sum of (i) the regular payout; and (ii) the enhanced progressive prize value when the progressive prize is won.

14. The gaming system of claim 13, wherein a portion of said components are embodied in a gaming machine.

15. The gaming system of claim 13, wherein the system comprises a plurality of gaming machines networked with a game server.

16. The gaming system of claim 15, further comprising a progressive display displaying the current value of progressive prize, and one said gaming machine comprising a progressive window displaying the enhanced progressive prize based on the second wager value received on said gaming machine, the enhanced progressive prize value being different from the current progressive prize value.

* * * * *